US011685023B2

(12) United States Patent
Soli

(10) Patent No.: US 11,685,023 B2
(45) Date of Patent: Jun. 27, 2023

(54) PLIERS TOOL

(71) Applicant: Paul Joseph Soli, Hazel Park, MI (US)

(72) Inventor: Paul Joseph Soli, Hazel Park, MI (US)

( * ) Notice: Subject to any disclaimer, the term of this patent is extended or adjusted under 35 U.S.C. 154(b) by 91 days.

(21) Appl. No.: 16/810,730

(22) Filed: Mar. 5, 2020

(65) Prior Publication Data

US 2020/0282524 A1 Sep. 10, 2020

Related U.S. Application Data

(60) Provisional application No. 62/813,929, filed on Mar. 5, 2019.

(51) Int. Cl.
*B25B 7/22* (2006.01)
*B25B 7/14* (2006.01)

(52) U.S. Cl.
CPC . *B25B 7/22* (2013.01); *B25B 7/14* (2013.01)

(58) Field of Classification Search
CPC .... B25B 7/00; B25B 7/02; B25B 7/06; B25B 7/22; B25B 7/14; B25B 7/16; B25B 7/18; B25B 7/20; B25B 9/00; B21D 39/025
See application file for complete search history.

(56) References Cited

U.S. PATENT DOCUMENTS 2,057,201 A * 10/1936 McCluskey ..... B25G 1/043 30/186
2,654,280 A * 10/1953 Hudnall ..... B25B 7/16 269/9
2,827,815 A * 3/1958 Smoyak ..... B25B 7/18 81/417
5,351,585 A * 10/1994 Leseberg ..... B25B 7/02 81/426
D368,631 S * 4/1996 Swierczynski ..... D8/4
5,931,453 A * 8/1999 Brennan ..... B25B 7/02 269/6
7,004,182 B2 * 2/2006 Duval ..... B08B 3/12 15/97.1
8,931,376 B2 * 1/2015 Humphrey ..... B25G 1/005 81/177.2
D763,050 S * 8/2016 Wu ..... D8/52
2007/0051213 A1 * 3/2007 Tyler ..... B25B 5/163 81/367

* cited by examiner

*Primary Examiner* — Robert J Scruggs

(57) ABSTRACT

A pliers tool (01) includes a hosting pliers that attaches to and manipulates a separate, principal use pliers (02) wherein the hosting pliers has as a first receiver and a first retainer as facilitated by a PLBA (50) that is connected to a first frontward ply (24*a*). The PLBA (50) is configured to receive and retain to a ply assembly of the hosting pliers a handle of the principal use pliers (02).

5 Claims, 4 Drawing Sheets

Fig.13
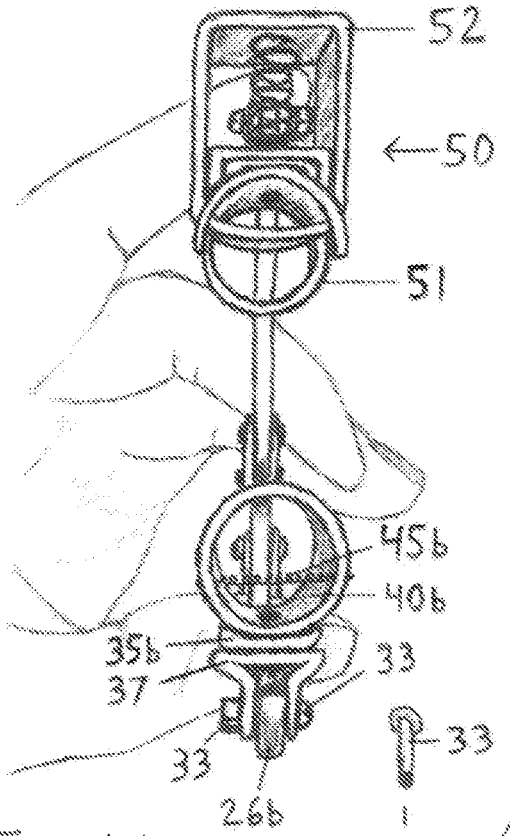
Fig.14
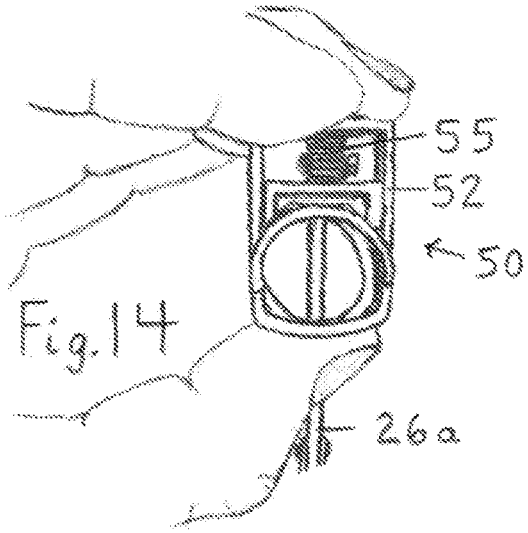
Fig.15
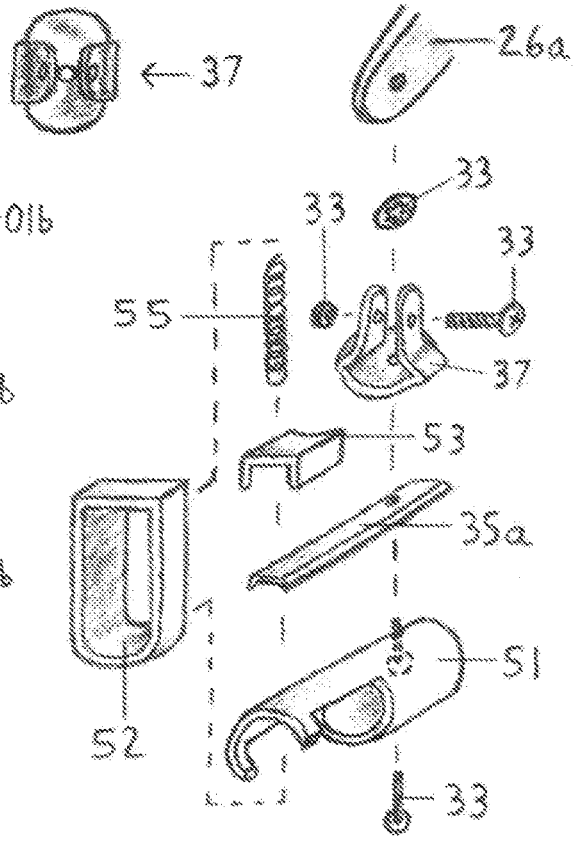
Fig.16
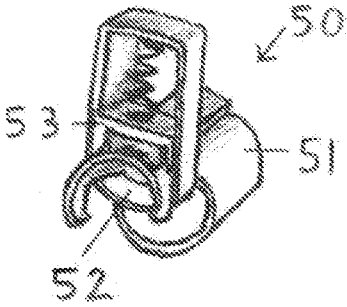
Fig.17
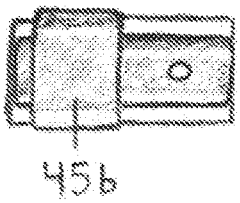
Fig.18
Fig.19

PLIERS TOOL

CROSS-REFERENCES TO RELATED APPLICATIONS

This patent application claims priority to U.S. Provisional Patent Application Ser. No. 62/813,929, filed Mar. 5, 2019, which is incorporated herein by reference in its entirety.

BACKGROUND

The present disclosure relates to an adaptative, multifunctional, pliers-enhancing tool.

Hand-held pliers include handles that lead to or are connected to jaws that may be used in various applications such as controlling a workpiece, turning fasteners or pipes, cutting various materials, or locking onto a workpiece. Each particular application may present challenges to a user that may be difficult to overcome such as grip comfort or sustainability on the handles; unsuitable overall length of the pliers for the application; ergonomic issues or obstructions contributed to by the pliers' handle orientation relative to the user; insufficient transfer of force from the handles (where force is applied) to its jaws directly engaging a workpiece; and an inability to lock onto a workpiece.

SUMMARY

Disclosed is a pliers tool including a hosting pliers that attaches to, retains, and manipulates a separate, principal use pliers.

The hosting pliers are specially designed, shaped and provided with a pressure loading box assembly to function as a receiver/retainer, which is integral to its first ply such that the pressure loading box assembly is configured to receive and retain a handle of the principal use pliers. The hosting pliers are further equipped with frontward and rearward pivot joints to facilitate better movement of the combination of the pliers tool and the principal use pliers.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

FIG. 13 is a front perspective of the pliers tool being held by a hand with the pressure loading box assembly in the second position.

FIG. 14 is a from perspective of the first jaw of the pliers tool being held by a hand with the pressure loading box assembly in the first position.

FIG. 15 is a perspective of one of the pivot/swivel mounting plates.

FIG. 16 is an isometric perspective of the pressure loading box assembly in the second position.

FIG. 17 is an overhead perspective of the pressure loading box assembly.

FIG. 18 is a disassembled perspective of the second receiver assembly with attaching hardware and one of the pivot/swivel mounting plates.

FIG. 19 is a disassembled perspective of the pressure loading box assembly with attaching hardware, one of the pivot/swivel mounting plates, and a portion of the first jaw of the pliers tool.

DETAILED DESCRIPTION

Figure 3:
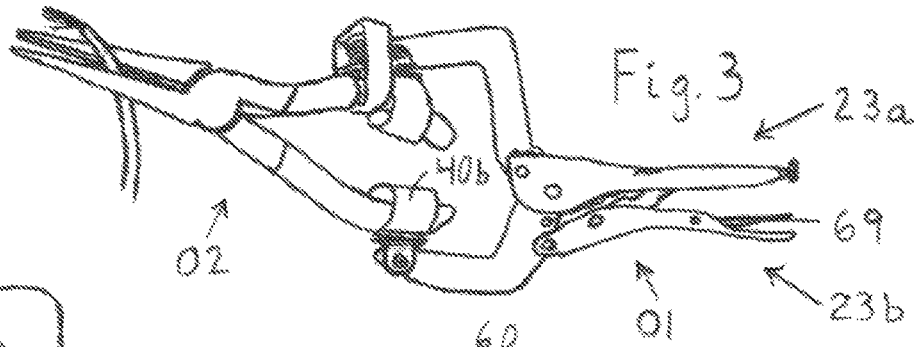
FIG. 3 is a side perspective of the pliers tool wherein its receiver assemblies are controlling the principal use pliers, which are shown holding a wire.
Figure 4:
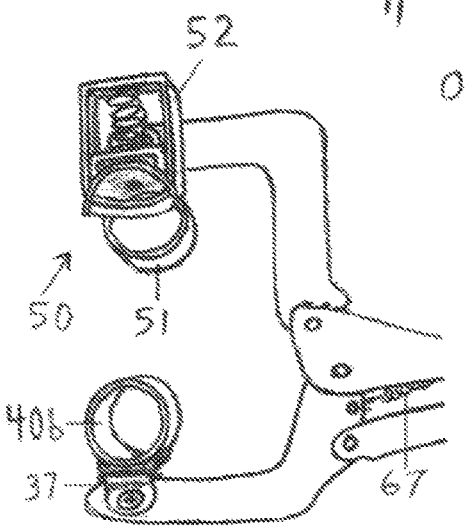
FIG. 4 is a side perspective of the frontward ply assemblies of the pliers tool with its receivers orientated away from its body.

Now referring to the figures, where the invention will be described with reference to specific embodiments, without limiting same, FIG. 3 illustrates a principal use pliers (02). The principal use pliers (02) may be used as a stand-alone tool consisting of two jaws, hingedly or otherwise movably connected to two handles. The principal use pliers (02) may be utilized to enable the manipulation of a workpiece, such as one found in manufacturing, construction, automotive, mechanical, electronics, electrical, medical, aeronautics, aerospace, forms of art, outdoor activities—including fishing, various hobbies—including model-building, and more without its user's hand having direct engagement with the workpiece.

The principal use pliers (02) may have an uncomfortable, damaged, or non-insulated handle, which may limit its mechanical or safe usefulness.

The handles of the principal use pliers (02) may be fixed in length, which may reduce the amount of force its user can apply to the jaws. The opposite could also be true in that the point of comfortable grip on the handles of the principal use pliers (02) may be inconveniently farther from the jaws than what is desirable, thereby producing a greater amount of force at the jaws than what is desired.

The principal use pliers (02) may have a fixed orientation of the handles to the jaws, which may reduce accessibility to a workpiece during specific tasks such as working around a physical obstruction in a confined space or when working overhead.

The principal use pliers (02) may have a fixed length at the handles, which may provide an insufficient lever arm for torque applications such that its user cannot sufficiently leverage the material in the jaws such as when trying to turn a stubborn fastener or bend sheet metal or other materials. Furthermore, a fixed length of the principal use pliers (02) may lead to the principal use pliers (02) being too short or too long for possible spatial limitations when held in the user's hand.

The principal use pliers (02) may have a fixed ratio of movement between its handles and the corresponding movement at its jaws. This relationship may prevent the application of force at the jaws to reach, without exceeding, a desired threshold in certain applications such as press-fitting or cracking a walnut's shell without damaging the meat.

The principal use pliers (02) may provide a fixed ratio between the force applied by the user and the resulting force at the jaws of the principal use pliers (02), thereby rendering the user unable to exert the minimum threshold of force necessary to manipulate materials as desired such as when cutting or gripping stubborn fasteners. Factors contributing to the problem of insufficient force for the task may include the user having reduced physical strength, muscle fatigue, injury, spatial limitations interfering with the user's grip, and/or other limiting conditions.

The principal use pliers (02) may not include a feature to lock the principal use pliers (02) onto a workpiece, a feature without which its user may be unable to apply the sustained force necessary to achieve certain tasks such as clamping or propping up a workpiece for bonding or joining operations such as soldering, brazing, bead-making, suturing, and/or other applications.

As shown in FIG. 3, a pliers tool (01) may be arranged to attach to the principal use pliers (02) to overcome the above identified limitations as well as other limitations associated with the principal use pliers (02).

As shown in FIGS. 1-7, the pliers tool (01) may:
provide solutions to an uncomfortable or damaged handle of the principal use pliers (02) by allowing its user to bypass direct engagement with the handles of the principal use pliers (02); create greater force or less force through mechanical advantage when attaching to different points on the handles of the principal uses pliers (02); provide dynamic handle/jaw orientation options with bi-directional pivot/swivel joints facilitated by pivot/swivel mounting plates (37) in the pliers tool (01), hereafter referred to as P/SMP's (37), which may be beneficial when working in challenging environments such as in congested areas or working overhead; enable greater or lesser torque application/leverage capabilities by creating an overall longer or shorter tool assembly by changing the insertion depths/attachment points of the handles of the principal use pliers (02) within a PLBA receiver (51) and a second receiver (40*b*) of the pliers tool (01); become an overall longer assembly or attach at a point on the handles of the principal use pliers (02) that is inaccessible to reach with a bare hand or disadvantageous to its user to apply the force needed for a given task; deliver increased and/or more steady force to the jaws of the principal use pliers (02) as facilitated by a four-bar linkage assembly (60), hereafter referred to as FBLA (60), since the FBLA (60) in the pliers tool (01) alters the ratio of movement between the handles of the pliers tool (01) where force is applied by the user and the resulting movement at the working end of the tool assembly—the jaws of the principal use pliers (02)—such that the handles of the principal use pliers (02) where force is applied by the pliers tool (01) move less in relationship to the handles of the pliers tool (01) where force is applied by its user, thereby compounding and modulating the force applied to the jaws of the principal use pliers (02) when compared to using the principal use pliers (02) as a stand-alone tool; enable the locking of the handles/jaws of the principal use pliers (02) into a plurality of positions to manipulate or support a workpiece as facilitated by the over-center condition of the FBLA (60).

Furthermore, the pliers tool (01) may provide solutions to a non-insulated handle of the principal use pliers (02) as the pliers tool (01) may be insulated. Similarly, various exposed parts of the pliers tool (01) may be insulated to prevent conduction between such parts and their surroundings, which could otherwise cause problems such as arcing, and/or damage to electronics.

Finally, additional benefits are explained in the specification.

The pliers tool (01) may be used to control the principal use pliers (02), and some of its construction methods and methods of use will now be described in conjunction with FIGS. 1-19.

As shown in FIGS. 1, 3, 6 & 7, inherent to the pliers tool (01) are jaws arranged to hold the handles of the principal use pliers (02) such that when the two units are connected together by the pliers tool (01) their user may overcome challenging or otherwise insuperable applications for the principal use pliers (02) alone such that the pliers tool (01) facilitates a relatively unimpeded, smooth and adequate range of motion for the combination of the pliers tool (01) and the principal use pliers (02) to be operated together in a range acceptable for the uses associated with the principal use pliers (02) and/or a new application.

As shown in FIGS. 1, 2, 6 & 7, the pliers tool (01) and the principal use pliers (02)/their combination may be movable between at least two positions, a first position (more open) and a second position (more closed). However, the pliers tool (01) and the principal use pliers (02)/their combination may be movable between ranges of positions.

Figure 2:
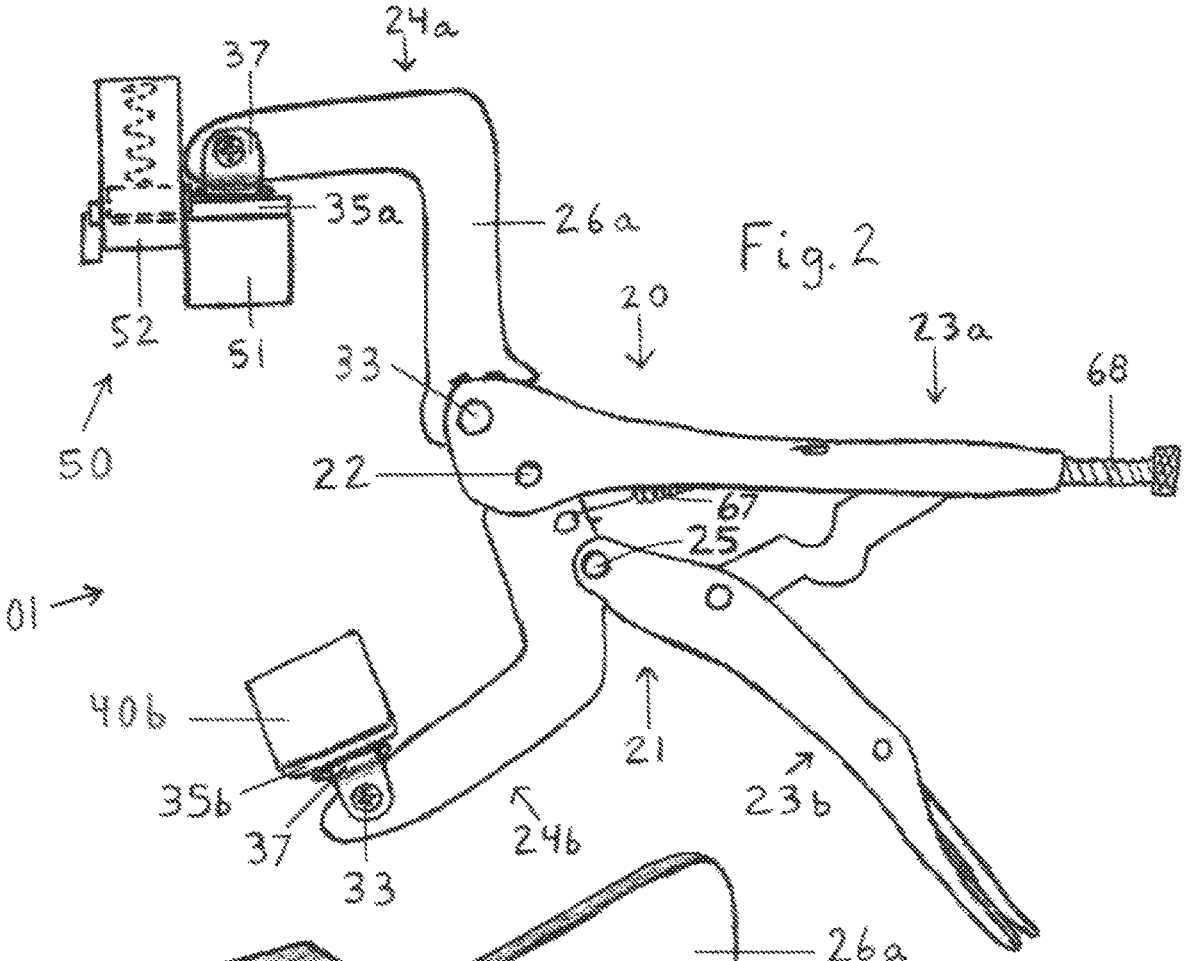
FIG. 2 is a side perspective of the pliers tool in the first position.

As shown in FIG. 2, the pliers tool (01) includes ply assemblies comprising a first ply (20) and a second ply (21). Said plies (20 & 21) are at least partially arcuate, curved, or otherwise sinuous, and they are hingedly or otherwise movably connected to each other by a primary main hinge (22), which extends at least partially through both plies as needed for attaching the two plies to each other.

Figure 1:
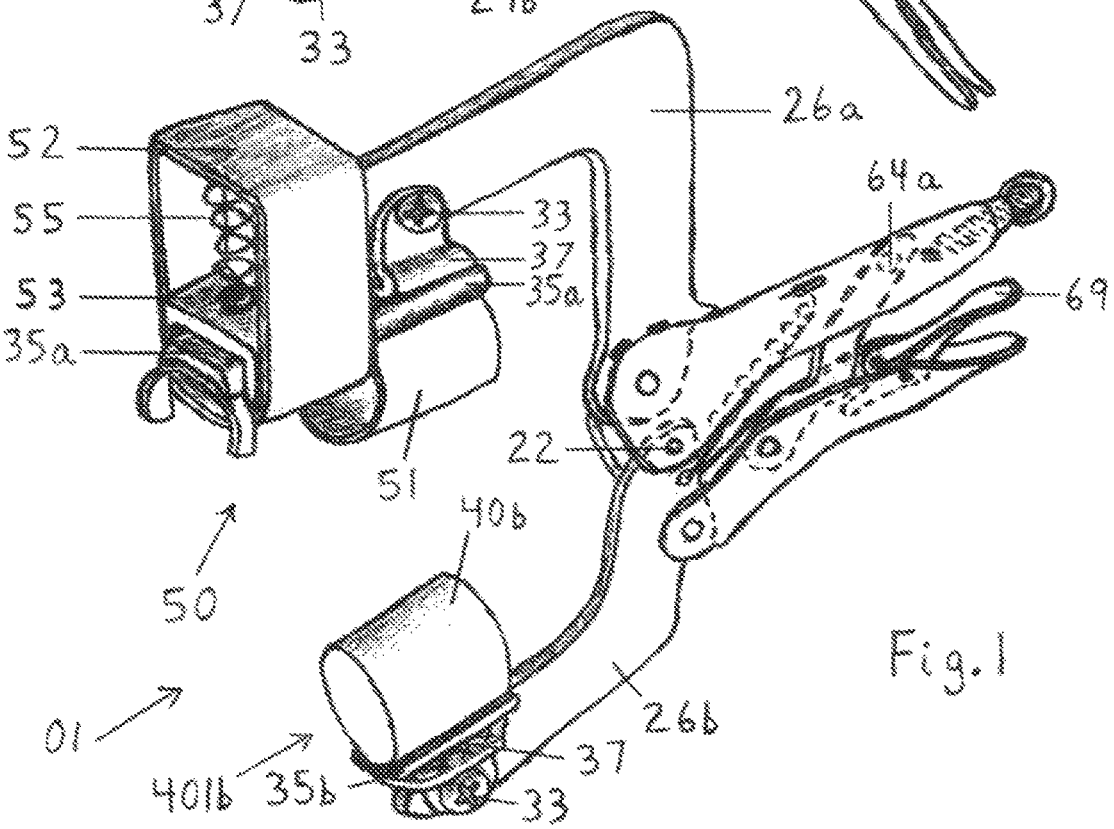
FIG. 1 is an isometric view of the pliers tool.

As shown in FIGS. 1 & 2, a first rearward ply (23*a*) and a second rearward ply (23*b*) of the pliers tool (01) are formed to be graspable as handles, and a first frontward ply (24*a*) and a second frontward ply (24*b*) are formed to provide a first jaw (26*a*) and a second jaw (26*b*) wherein each of the rearward and frontward plies ends at and partially includes at least one of two main hinges that attaches the plies to each other and distinguishes them from their adjoining plies such that the primary main hinge (22) distinguishes the first rearward ply (23*a*), which extends rearward through an FBLA adjustment screw (68) to its rearward end, from the first frontward ply (24*a*), which extends frontward through a rigid, structural joint having tack/spot-welds and attaching hardware (33) that fixedly secures the first jaw (26*a*) as a member of the first frontward ply (24*a*), and a pressure loading box assembly (50), hereafter referred to as PLBA (50), to its frontward end; and a secondary main hinge (25) distinguishes the second rearward ply (23*b*), which extends rearward through and includes an FBLA release lever (69) near its rearward end, from the second frontward ply (24*b*), which extends frontward through a second receiver assembly (401*b*) to its frontward end.

As shown in FIGS. 1 & 2, the second jaw (26*b*) is a member of the second frontward ply (24*b*) and is hingedly connected at both of the two main hinges (22 & 25), whereas the first jaw (26*a*) is a fixedly-attached member of the first frontward ply (24*a*).

Figure 5:
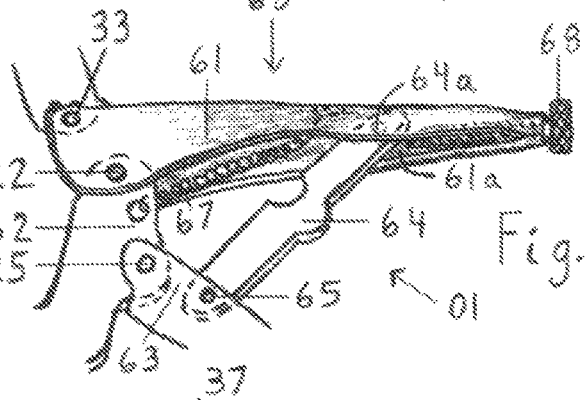
FIG. 5 is an isometric perspective of the pliers tool in the first position.

As shown in FIGS. 2, 3, & 5, the first and second rearward plies (23*a* & 23*b*) are further connected to each other by an FBLA rearward bar (64), which is explained in detail later in the specification as part of the FBLA (60) present in the pliers tool (01).

As shown in FIGS. 1, 2, 5, 6 & 7, formed within the graspable, direct-engagement user's handles of the pliers tool's (01) first and second rearward plies (23*a* & 23*b*) is the FBLA (60), an integrally applied concept inherent to the pliers tool (01) that is made up of four bars having the reference sign range (61-64); the full range of reference signs illustrating the FBLA (60) span from (61-69), including sub-letters.

As shown in FIGS. 1, 2, 5, 6 & 7, the FBLA (60) comprises elements wherein an FBLA First ply bar (61) is a section of the first rearward ply (23*a*) assembly partially including and extending from the primary main hinge (22) at one end and continuing to and partially including at its other end an FBLA adjustable hinge (66) along the First rearward ply (23*a*); an FBLA frontward bar (62) is an intermediate section of the second frontward ply (24*b*) partially including and having at each end one of the two main hinges (22 & 25) and spanning from one to the other; an FBLA second ply bar (63) is a section of the second rearward ply (23*b*) partially including and extending from the secondary main hinge (25) at one end and continuing to and partially including at its other end an FBLA over-center hinge (65); the FBLA rearward bar (64) is a member partially including and extending from the FBLA over-center hinge (65) at one end and continuing to and partially including at its other end the FBLA adjustable hinge (66) along the first rearward ply (23*a*); the FBLA adjustable hinge (66) is formed by a confluence of the FBLA first ply bar (61) and the FBLA rearward bar (64) where they engage together the hinge-end of the FBLA adjustment screw (68) such that their containment within an FBLA slotted tubular section (61*a*) is supported and maintained by an FBLA rear bar raised protrusion (64*a*) at the end of the FBLA rearward bar (64) such that said raised protrusion (64*a*) is large enough to retain the end of the FBLA rearward bar (64) within said slotted tubular section (61*a*) of the first rearward ply (23*a*) while being small enough, smooth enough, and shaped accordingly to fit and move freely within and along said slotted tubular section (61*a*); an FBLA tension spring (67) attaches at one end to the FBLA frontward bar (62) and at the other end to the FBLA first ply bar (61) such that the FBLA rearward bar (64) is driven by the force of the FBLA tension spring (67) to slide internally along the FBLA slotted tubular section (61*a*) of the FBLA first ply bar (61) until it engages and is stopped by the hinge-end of the FBLA adjustment screw (68), which is threaded into the rearward end of the first rearward ply (23*a*), and the spring tension applied by the FBLA tension spring (67) transfers through the entire, hingedly-formed FBLA (60); and the FBLA release lever (69) is movably attached with attaching hardware (33) to the rearward section of the second rearward ply (23*b*).

Further descriptions of the FBLA's (60) components and explications of its general functions and transitive benefits in the pliers tool (01) are given later in the specification.

As shown in FIGS. 1, 2, 6 & 19, used as needed anywhere in the pliers tool (01) may be attaching hardware (33), which may include nuts/bolts, washers/push washers, studs, spring washers, rivets, and/or a variety of other hardware options to fasten and/or connect any parts or assemblies included with the pliers tool (01) such that said connections may be either static or dynamic at any time, depending on needs and design/construction. Attaching hardware (33) may be used in conjunction with other connection materials and/or methods such as adhesives, welding, and more.

However, the pliers tool (01) may comprise integrally formed parts wherein two or more parts are formed as one part that may otherwise comprise attaching hardware (33). Said hardware (33) may be used at any attachment/connection locations of the pliers tool (01) where applicable, and it should be considered for its potential benefits and/or limitations, including, but not limited to, function, cost, strength, tool longevity, weight, space limitations/part interference, and more, whether used by itself or in conjunction with another connection material and/or method, such as a modern adhesive, press-fitting, geometric pinning, friction-based construction, soldering, brazing, welding, the use of magnets, or any other connection methods that may be applicable when connecting together any two or more parts of the pliers tool (01), whether in a static or dynamic capacity at any time.

As shown in FIGS. 1, 2, 11, 13, 14, 16 & 19, the first frontward ply (24*a*) comprises the fixedly-attached first jaw (26*a*) and at its frontward end the PLBA (50) that further comprises: the PLBA receiver (51); a PLBA band (52), as a retainer; a PLBA band guide (53); and a PLBA spring (55). The first frontward ply (24*a*) further comprises a first receiver attaching plate (35*a*), one of the P/SMP's (37), and attaching hardware (33) such that the PLBA (50) is fastened with attaching hardware (33) to one of the P/SMP's (37) and the combined assembly is movably fastened with attaching hardware (33) to the first jaw (26*a*).

As shown in FIGS. 1, 13, & 16, the PLBA (50) extends from or is integrally formed with a portion of the first jaw (26*a*) wherein the PLBA receiver (51) directly engages a handle of the principal use pliers (02).

As shown in FIGS. 3, 11, 13, 14 & 19, the PLBA (50) is arranged to facilitate the dynamic requirements of both a receiver and a retainer as part of the pliers tool (01) such that the arrangement of the PLBA's (50) moving and non-moving parts enable the PLBA receiver (51) and the interactive, pressure-based PLBA band (52) to be forcefully guided toward each other such that they create a movement-compensating vice/retainer for a handle of the principal use pliers (02).

However, the PLBA (50) could function beneficially to receive and attach to a different prominent protrusion, separate from the Pliers Tool (01).

As shown in FIGS. 4, 13, 14 & 19, the PLBA receiver (51) and the PLBA band (52) may each generally be a single, hollow or open member of the PLBA (50); however the material(s) and/or method(s) of construction used in the PLBA (50) to receive and/or retain a handle of the principal use pliers (02) may be a combination of different materials and/or methods, potentially even incorporating into a single component the functions or partial functions of both receiving and retaining a handle of the principal use pliers (02) such as with a hook and loop fastener, an elastic-type of material, a magnetic attachment, or another applicable material and/or method, whether more flexible or more rigid, that serves to both receive and retain a handle of a principal use pliers (02).

As shown in FIGS. 3, 6, 7, 10, 11, 13, 14, 16 & 19, the PLBA receiver (51) and the PLBA band (52), as a retainer, work together such that the PLBA band (52) is a generally open member having a guided travel for retention/closure through the PLBA receiver (51) opening that may be partially occupied by a handle of the principal use pliers (02) positioned between an interior, more curved surface and an opposing interior surface of the PLBA receiver (51). Interior walls of the PLBA band (52) are guided by external surfaces on sides of cut-out sections of the PLBA receiver (51) and/or the PLBA band guide (53).

As shown in FIGS. 1, 10, 13, 14, 16 & 19, the PLBA band guide (53) is attached by attaching hardware (33), adhesive, a weld, their combination, or by other means, superimposing it over the first receiver attaching plate (35*a*) where it assists in guiding the travel of the PLBA band (52). However, the PLBA band guide (53) and/or the first receiver attaching plate (35*a*) may be integrally formed as one part or into another part or parts of the PLBA (50), such as the PLBA receiver (51). Separately, the PLBA spring (55) also contributes in supporting and guiding the PLBA band (52) by having some integral rigidity, and its function could be made more primary in this regard, such as by using a larger spring, a more robust spring, or by using more than one spring.

As shown in FIGS. 3, 10, 11, 13, 14, 16 & 19, the PLBA spring (55) is compressed between and applies force against a primary exposed surface of the PLBA band guide (53) and an opposing, interior side of the PLBA band (52) where its end positions are secured by an adhesive, a weld, or another method of securement.

As shown in FIGS. 3, 10, 11, 13, 14, 16 & 19, the arrangement of parts in the PLBA (50) are such that the PLBA spring (55) forces the PLBA band (52) reward the PLBA receiver (51) so as to retain by pinning between them a handle of the principal use pliers (02). In this parts assembly/relationship, the PLBA (50) allows a handle of the principal use pliers (02) to have some movement between the PLBA receiver (51) and the PLBA band (52) within the assembly without the assembly releasing the handle as enabled by secure, but somewhat loose, construction considered in the relationship between the PLBA band (52) and one or more parts acting to support and/or guide the PLBA band (52), such as the PLBA receiver (51) and/or the PLBA hand guide (53). The aforementioned, loose construction may facilitate a more accommodating, compensatory capacity of the PLBA (50) to better meet the demands of the pliers tool (01) and the principal use pliers (02) as they work together.

While the PLBA (50) is designed as a movement-compensating receiver/retainer assembly, the PLBA (50) could also function as a non-compensatory, more rigid receiver/retainer assembly such as by tightening tolerances; changing part orientations; changing part geometry; utilizing different materials such as those that may be more sacrificial and/or more withstanding; and/or incorporating more or less mass or volume to certain elements.

As shown in FIGS. 1, 2, 4, 6, 7, 18, & 19, the receiver assemblies comprising the PLBA (50) and the second receiver assembly (401*b*) each attach movably to the frontward end of its respective first or second jaw (26*a*/26*b*) such that the attaching plate of each assembly, the first receiver attaching plate (35*a*) and a second receiver attaching plate (35*b*), is movably connected to one of the P/SMP's (37) by attaching hardware (33) that begins its retention in each assembly with a shaft component having an oversized, widened head/end for retention such that after being passed through the receiver it retains the receiver from an interior location within the receiver where a hole has been drilled through the receiver to accommodate the shaft that secures the receiver as part of the assembly.

As shown in FIGS. 18 & 19, the attaching hardware (33) shaft component that retains each receiver continues its assembly-retention function in each assembly by passing through a drilled hole in each attaching plate and a drilled hole through the center of one of the P/SMP's (37) where it is then secured to said P/SMP (37) with a retaining washer or other attaching hardware (33) and/or method. Said P/SMP (37), having attached to it a receiver assembly, is then attached to its respective jaw with attaching hardware (33), such as a small nut/bolt arrangement, wherein the bolt passes through holes drilled through each of two exposed protrusions of the P/SMP (37) and the frontward end of the jaw, astride which they are configured, before being secured with a nut, or by another method.

Either receiver assembly may comprise more than one component; however, components of a receiver may be formed by a single member wherein multiple components are forged, cast, cut, molded, or otherwise formed into a single component.

Figure 6:
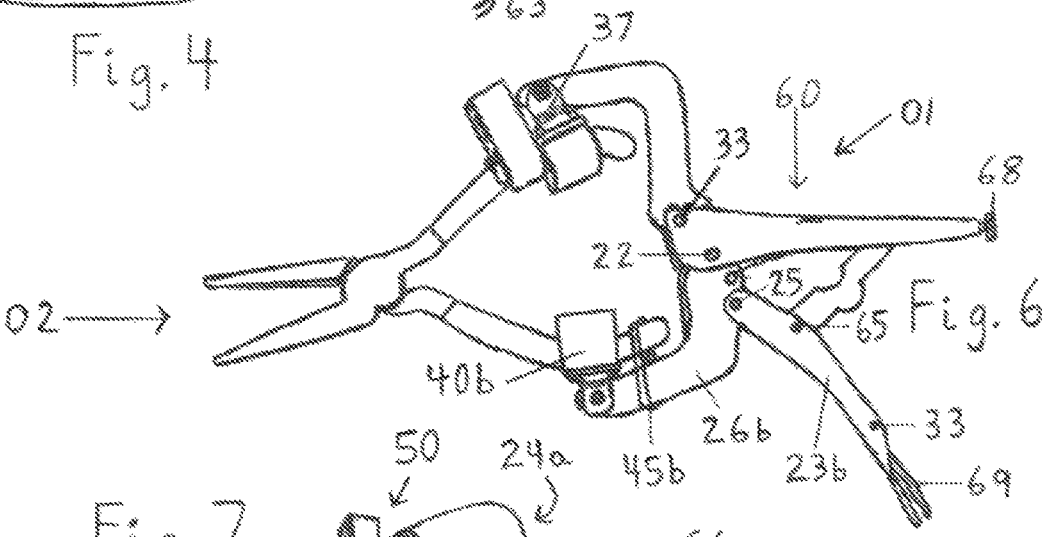
FIG. 6 is a side perspective of the pliers tool hosting the principal use pliers with both tools in first positions.
Figure 7:
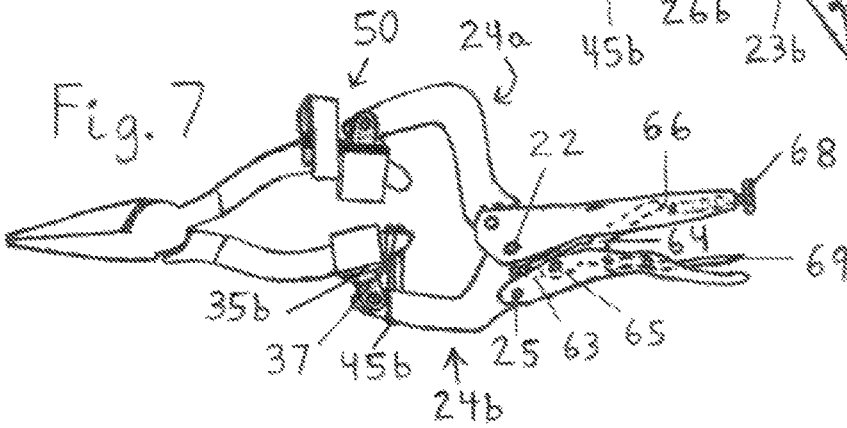
FIG. 7 is a side perspective of the pliers tool hosting the principal use pliers with both tools in second positions.
Figure 8:
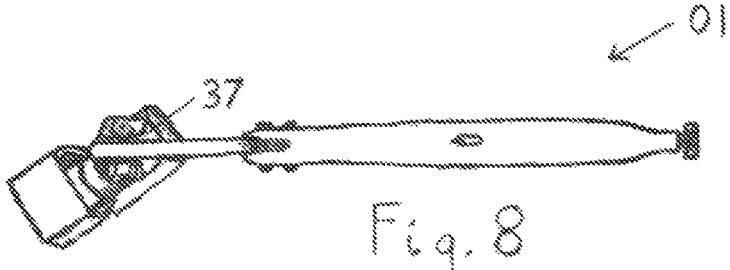
FIG. 8 is an overhead perspective of the pliers tool.
Figure 9:
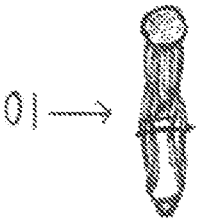
FIG. 9 is a rear perspective of the rearward ply assemblies of the pliers tool.

As shown in FIGS. 6 & 7, each of the P/SMP's (37) is hingedly or movably attached to each jaw so as to allow a handle of the principal use pliers (02) to pivot forward and rearward relative to the pliers tool (01) while their combination remains on an axis/plane generally shared between them. The P/SMP's (37) frontward and rearward pivoting allowances help to facilitate movement needed for the normal opening and closing of the principal use pliers (02) hosted by the pliers tool (01) such that each of the P/SMP's (37) independently accommodates variations in movements of a handle of the principal use pliers (02) supported by a receiver of the pliers tool (01) without binding or limiting its range of pivoting or teetering forward and rearward relative to the pliers tool (01) as the pliers tool (01) and the principal use pliers (02) open and close together.

As shown in FIGS. 1, 2, 3, 4, 7, 8, 18 & 19, the first and second receiver attaching plates (35*a* & 35*b*) each attach to one of the P/SMP's (37) such that their junction is formed by their generally flat mating surfaces which when pressed together facilitate the swiveling motion of their respective receiver, which in turn enables a handle of the principal use pliers (02) to orientate away from the body of the pliers tool (01) on a rotational axis/plane such that when both receivers are equipped to and forced to swivel together the handles of the pliers tool (01) and the principal use pliers (02) each occupy separate planes as opposed to the single, general-geometric plane otherwise shared by their handle-sets.

Said moveable swivel-junctions at the P/SMP's (37) and the first and second receiver attaching plates (35*a* & 35*b*) facilitate swiveling to enable multi-planar orientations that increase the versatility and functionality of the pliers tool (01).

While the pliers tool (01) comprises joints and assemblies that enable both pivoting and swiveling, the pliers tool (01) could be made to facilitate only one pivot point for only one handle of a principal use pliers (02); likewise, the pliers tool (01) could have more than one pivot location for a handle of a principal use pliers (02). Furthermore, the pliers tool (01) could not have any of said pivot points, and any swivel-junctions are subject to the same potential in that they may or may not exist in the pliers tool (01), or the pliers tool (01) may have more than one swivel-junction on either frontward ply.

As previously described and shown in FIGS. 3, 4, 7 & 8, the P/SMP (37) may facilitate a free range of rotation without additively having any restrictive, friction principles or specified stopping points limiting its swiveling capacity; however, a more rigid, more stable, or fixed-adjustmentbased swiveling junction could be incorporated into one or more of the P/SMP (37) junctions to control the changing axial orientation of the principal use pliers (02) relative to the pliers tool (01) and its user such as by having a ball/detent or spring-loaded, pin/hole arrangement between mating surfaces at the junction, or incorporating friction-producing knurling, or offset ridges and valleys on opposing mating surfaces so as to allow for mating of ridges and valleys in specific, more secure positions. Other limiting arrangements could include materials and/or methods such as a magnet; a repositionable, indexable, swivel-junction interface; and/or removable/replaceable parts, or the combinations of any two or more limiting methods.

Similarly, restrictive materials and/or methods could be used to change or apply tension at a pivot joint where one of the P/SMP's (37) attaches to the frontward end of a jaw and/or at another location on a frontward ply assembly that may be chosen for a modification/addition of a swivel-junction interface to facilitate different assembly-arrangement orientations.

While a swivel-junction interface in the pliers tool (01) may inherently have relatively unimpeded rotational travel, if the FBLA (60) in the pliers tool (01) locks the principal use pliers (02) onto a workpiece, for example, the otherwise relatively unimpeded rotational travel may become substantially reduced as the rigidity of the entire arrangement increases, potentially to the benefit of the user.

As shown in FIGS. 4, 6, 7 & 13, the pliers tool (01) may have only one retainer; however, the pliers tool (01) may have more than one retainer. Furthermore, the pliers tool (01) may have more than one retainer on one frontward ply.

As shown in FIGS. 1, 2, 6, 7 & 13, the PLBA (50) functions as a receiver/retainer assembly of the first frontward ply (24*a*) of the pliers tool (01); however the pliers tool (01) may comprise more than one PLBA (50) or other forms of receiver/retainer assemblies/arrangements, or any combination thereof, such as the pliers tool (01) potentially having on both plies only one receiver/retainer assembly variation such as one of those shown on the second frontward ply (24*b*) examples in FIGS. 6, 7 & 13, wherein a second retainer (45*b*) comprises an elastic band, or a coil spring spanning across the frontward, inside portion of the second receiver (40*b*) such that it passes through two small holes drilled through the receiver, one on each side, where its ends are then secured within the holes or to the outsides of the receiver by crimps, tack/spot-welds, adhesives, their combinations, or another method of attachment.

As shown in FIG. 6, some elements of the PLBA (50) on the first frontward ply (24*a*) may be integrally formed together as two or more elements in one, such as with the single-component combination of the first receiver attaching plate (35*a*) and the PLBA band guide (53); however, the PLBA (50) may be absent one or more of its elements and/or comprise additional elements while performing its functions as a receiver/retainer.

Separately, such as illustrated in the aforementioned examples shown in FIGS. 6 & 7, on the second frontward ply (24*b*) the pliers tool (01) may have a different receiver/retainer arrangement in plate of the PLBA (50), such as one that is a separated arrangement having more than one part or assemblies wherein a hollow member receives a handle of the principal use pliers (02) at the frontward section of the second jaw (26*b*) and an elastic band retains said handle to the second frontward ply (24*b*) at a more rearward location. Reversing said orientation, however counter-intuitive, could also function in place of the PLBA (50) such that a retainer, such as an elastic band, could be located more frontward on the frontward ply relative to its structurally more integral receiver, which could be attached to the jaw at a more rearward location in a hinged manner by the short, smooth, shoulder section of a partially threaded bolt, for example, passing through one side of the second receiver (40*b*) and securing it to the side of the jaw at a tapped hole within the jaw at a location more rearward on the second frontward ply (24*b*). Furthermore, a retainer could even comprise its retention, at least in part, through an additive, external part or as an extended function of a rearward ply, whether by simply attaching a clamp to the end of a handle of the principal use pliers (02) after inserting it into a receiver; by affixing an elastic band to a rearward ply of the pliers tool (01) and to the opposite end of said band affixing a clamp that attaches to a handle of the principal use pliers (02) supported by a receiver on a frontward ply; or another method.

What's more, a retainer could comprise the use of other materials and methods such as attaching to the handles of the principal use pliers (02) a magnet or clamp that is further attached to a flexible material that is affixed to a frontward or rearward ply of the pliers tool (01). Other variations of retention could include attaching an elastic band or rigid material such as a wire with clamps on each end to the ends of both handles of the principal use pliers (02) after being inserted into their respective receivers and then potentially further attaching said band or material to a point on the pliers tool (01), such as with a magnetic or hooked attachment at the primary main hinge (22).

As shown in FIGS. 1, 2, 4, 13 & 18, at the frontward end of the second frontward ply (24*b*) the second receiver assembly (401*b*) comprises the second receiver (40*b*); the second receiver attaching plate (35*b*); one of the P/SMP's (37); and attaching hardware (33).

The second receiver (40*b*) extends from or is integrally formed with a portion of the second jaw (26*b*) wherein it directly engages a handle of the principal use pliers (02).

As a tool modification, the pliers tool (01) may comprise the designed components necessary to transition the principal use pliers (02) from an already existing tool having a principal purpose of direct engagement with a workpiece at the jaws of the principal use pliers (02) into the pliers tool (01), as opposed to forming the entire pliers tool (01) at one time. Such a transition may be facilitated by attaching, for example, separate modification members such as only the PLBA (50) and a separate receiver to the jaws of the otherwise principal use pliers (02), such as with a clamp exterior sleeve/set screw retainer, or other material(s)—whether flexible or rigid—and/or method(s), thereby facilitating the tool's transition from the principal use pliers (02) to the pliers tool (01).

Located on a jaw within the pliers tool (01), a receiver may be defined as an integral, handle-receiving connection part(s) that directly contacts and supports a handle of the principal use pliers (02) such that it withstands the forces applied on said jaw of the pliers tool (01) during use. A receiver may work indirectly or directly in conjunction with a retainer or have a design such that a retainer is inherent to the receiving connection.

Within the pliers tool (01), a retainer may be an adjunct or ancillary component to a receiver; however, a pliers tool (01) must have at least one member functioning as a retainer such that it retains a handle of a principal use pliers (02). A retainer may be anywhere on the pliers tool (01) or even be added to the pliers tool (01) or a principal use pliers (02) as a separate device or component, such as to seat a snug-fitting foam or rubber grommet, gasket, putty or other retaining material onto a handle of the principal use pliers (02) prior to inserting it into a receiver and then possibly attaching another, similar functioning retainer onto the same handle, but on the other side of the receiver, so as to pin/sandwich the handle on both sides to the receiver. A single, somewhat similar functioning retainer could attach to a handle on just one side of a receiver or simply be placed around a handle and then stuffed into the receiver to retain a handle of the principal use pliers (02).

A receiver member without a fully encompassing handle support could also be used in the pliers tool (01) and still support a handle by incorporating one of the aforementioned flexible, tacky materials or other materials and/or methods.

As shown in FIGS. 13 & 14, the PLBA (50) in the pliers tool (01) may be considered normally more closed in the second position and normally more opened in the first position wherein the compression of the PLBA spring (55) keeps the PLBA (50) in a normally more closed or second position when not compressed further such as by the force of the user's hand when inserting a handle of the principal use pliers (02) into the pliers tool (01).

However, the PLBA (50) may comprise magnets, for example, or other means to create pressure, retention, or closure wherein the PLBA (50) could through the use of magnetic or other forces be either normally more closed or normally more opened in a first position, such as by using a temporary catch to impede the progress of the PLBA spring (55) that closes the PLBA band (52) acting as a retainer, thereby holding the PLBA band (52) that closes the PLBA receiver (51) suspended in a more open position; relocating the arrangement of the PLBA spring (55); incorporating a hinged, tubular section with a latching closure as a receiver and/or retainer member; moving and relocating an attached magnet into different restricting positions such as if the magnet is attached to a swivel, hinge, or sliding mechanism and then moved to different positions; or other attachment means.

Now further describing parts and explicating more in detail with supporting figures the general functions and transitive benefits of the FBLA (60) in the pliers tool (01): As shown in FIGS. 1, 5, 6 & 7, the FBLA second ply bar (63) and the FBLA rearward bar (64) may become parallel to each other under load across the FBLA over-center hinge (65) if the jaws of the pliers tool (01) are closed with enough force by its user to overcome an opposing counter-force of a workpiece, for example, providing the FBLA adjustment screw (68) is positioned to facilitate said parallel bars (63 & 64) under load. Once said two bars (63 & 64) become parallel—making a single, hinged, linear bar—under load and they are further forced to break parallel on the opposite side from where they started, by the laws of physics they become locked into position if their continued movement on the opposite side from where they started is restricted somewhere generally understood to be "over-center" or beyond parallel. At this point, the force of said workpiece once working to separate the jaws of the pliers tool (01) is redirected through the linkage assembly such that it keeps the jaws of the pliers tool (01) locked closed indefinitely until either a disrupting, external-disengagement force is applied, such as intentional disengagement by the user, or the tool arrangement or workpiece fails.

As shown in FIGS. 1, 5, 6 & 7, the FBLA over-center hinge (65) associates the FBLA second ply bar (63) and the FBLA rearward bar (64) with being "over-center" relative to itself and both the secondary main hinge (25) and the FBLA adjustment hinge (66) wherein their beyond-parallel, over-center condition is configured to stop slightly over-center when the curved section of the FBLA rearward bar (64) is pressed against the frontward end of the FBLA release lever (69) to the extent that the force against the frontward end of said release lever (69) will pop the rearward end of said release lever (69) into the ready position for disengaging the over-center locking feature when both the FBLA rearward bar (64) and the frontward end of the FBLA release lever (69) are stopped together by the body of the second rearward ply (23*b*). Once locked into an exposed, ready position, squeezing the rearward end of the FBLA release lever (69) firmly toward the body of its respective handle creates a leveraging force that should separate the handles enough to bring the two bars back across parallel to overcome and disengage the over-center, locking feature.

As shown in FIGS. 1, 3, 6 & 7, the FBLA release lever (69) is attached to the rearward portion of the second rearward ply (23*b*); however, any arrangement or location of parts and/or hardware on the pliers tool (01) capable of overcoming the aforementioned, over-center condition could be used to disengage its FBLA (60) locking feature.

The over-center condition could also be arranged to be released by simply separating the handles forcibly by hand—without the need for the FBLA release lever (69)—if the over-center condition is stopped shortly enough in its geometric travel progress relative to its hinge points after becoming over-center so that it simply does not become prohibitively difficult to separate the handles manually for disengagement, which could be achieved through tighter tolerances and/or changing the geometry of the parts in the linkage assembly to limit the progression of the over-center condition, once achieved, relative to its respective hinge points. Additionally, geared parts or geometric, compounding-leverage components could be incorporated into the linkage assembly such that the disengagement of the over-center condition could be achieved with less externally-applied force.

Additionally, though possibly more involved and more expensive to manufacture than eliminating a release bar, the pliers tool (01) could incorporate a self-adjusting mechanism, which would eliminate the need for an adjustment screw as part of the FBLA (60).

The pliers tool (01) may or may not comprise a variation of the FBLA (60) that may or may not require the FBLA release lever (69), and any such FBLA (60) may be manually adjustable (with an adjustment screw) or self-adjusting (without an adjustment screw); however, the pliers tool (01) may be absent of any four-bar linkage assemblies.

Figure 10:
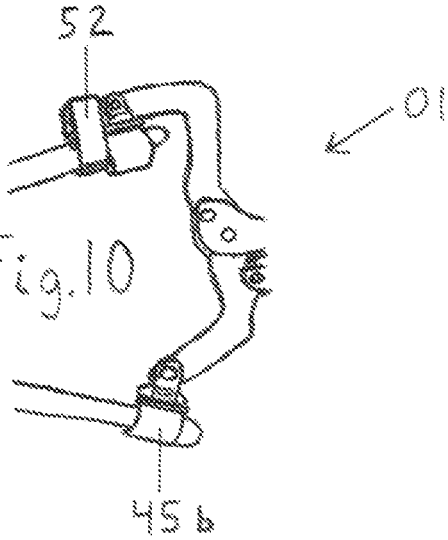
FIG. 10 is a side perspective of the pliers tool hosting the principal use pliers wherein the second receiver assembly of the pliers tool has been transposed to the second jaw to accommodate the larger principal use pliers in the receivers of the pliers tool.
Figure 11:
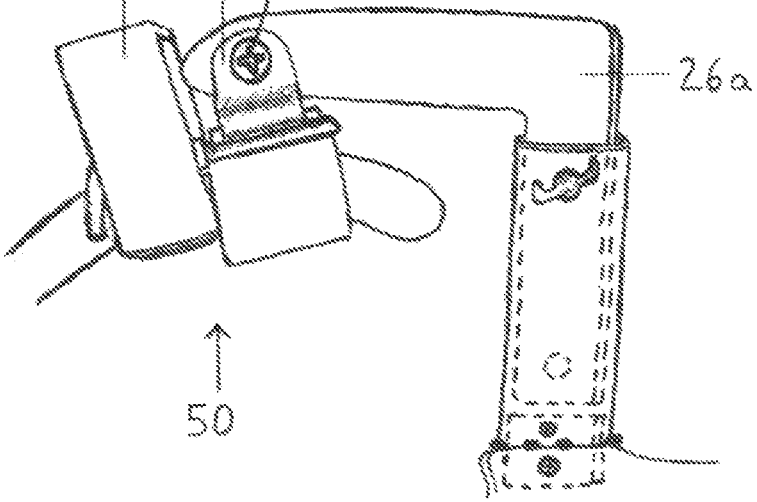
FIG. 11 is a side perspective of the pliers tool's first frontward ply assembly having an adjustable jaw and demonstrating the compensatory capacity of the pressure loading box assembly.
Figure 12:
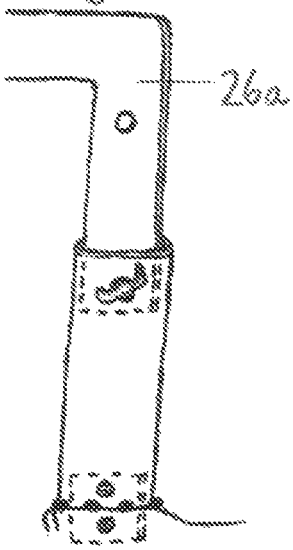
FIG. 12 is a side perspective of the pliers tool having the adjustable jaw.

Further describing and expounding on subjects pertaining to the pliers tool's (01) materials and/or methods of use, with supporting figures:

As shown in FIGS. 10, 11 & 12, the pliers tool (01) may incorporate quick and simple, yet sturdy and substantial adjustments in overall jaw capacity or throat depth by having, for example, a transposable receiver that can be flipped around the jaw from a relative interior area to a relative exterior area, thereby further separating the receivers from each other. Shown with the first jaw (26*a*) in FIGS. 11 & 12, an adjustable frontward ply could comprise overlapping sections or sleeved and inserted sections of the ply for adjustments, potentially including replaceable and/or variable-length sections along the length or height of the ply so as to overcome obstacles and/or change the jaw capacity, for example.

The pliers tool (01) may also utilize an extension method at one or both handles so that the overall length of the pliers tool (01) may be adjusted to change its leveraging capacities, for example.

By combining described configurations and attachment principles of the P/SMP (37) junctions with the sleeve/shaft principles in the extendable jaw concept shown in FIGS. 11 & 12, in conjunction with other methods and principles, an adjustable arrangement could be made of offset and operate the jaws and receivers of the pliers tool (01) through an entirely separate axis from the axes occupied/facilitated by the body of and the P/SMP's (37) in the pliers tool (01) so as to allow the handles of the principal use pliers (02) to move entirely out of the general plane occupied by the body of the pliers tool (01) such that they could remain parallel to the pliers tool (01) and relatively next to or on the side of it. This potential, true multi-axes adjustability in the pliers tool (01) could further augment its usefulness and value.

Each receiver in the pliers tool (01) is arranged to support a handle of the principal use pliers (02) using materials and/or methods that may include: air pressure/pneumatics, hydraulics, an adhesive-type material a ball/detent arrangement, a band, a bladder or pressure-based mechanism, a bracket, a buckle, a cam mechanism, a channel, a clamp, a clip, a collapsing shape such as a conical shape, a flexible material (such as cloth, foam, plastic, rubber, or metal tie), a groove, a hook, a hook and loop fastener, a lever, a magnet, a malleable material (possibly putty), a nut/bolt arrangement, a pawl/tooth arrangement, a pocket, a post (or other protrusion), a post in hole arrangement, a tie such as rope, a seam, a sleeve, a slot, a snap, a sock, a spring, a sticky substance, a string, a strap, a tab, a textured surface, a threaded post into a tapped hole, a tube, a retaining pin, a variable shape, a vice, or the like as made by synthetic, natural or combined materials.

Each retainer in the pliers tool (01) is arranged to retain a handle of the principal use pliers (02) using materials and/or methods that may include: air pressure/pneumatics, hydraulics, a 4-bar-linkage, an adhesive-type material, a ball/detent arrangement, a band, a bladder or pressure-based mechanism, a bracket, a buckle, a cam mechanism, a channel, a clamp, a clip, a collapsing shape such as a conical shape, a flexible material (such as cloth, foam, plastic, rubber, or metal tie), a groove, a hook, a hook and loop fastener, a lever, a magnet, a malleable material (possibly putty), a nut/bolt arrangement, a pawl/tooth arrangement, a pocket, a post (or other protrusion), a post in hole arrangement, a tie such as rope, a seam, a sleeve, a snap, a slot, a sock, a spring, a sticky substance, a string, a strap, a tab, a textured surface, a threaded shaft into a tapped hole, a tube, a retaining pin, a variable shape, a vice, or the like as made by synthetic, natural or combined materials.

As shown in FIGS. 1, 3, 6 & 7, inherent to the pliers tool (01) are movable jaws arranged to hold the handles of the principal use pliers (02) such that when the two units are connected together by the pliers tool (01) their user may overcome challenging or otherwise insuperable applications for the principal use pliers (02) alone such that the pliers tool (01) facilitates a relatively unimpeded, smooth and adequate range of motion for the combination of the pliers tool (01) and the principal use pliers (02) to be operated together in a range acceptable for the uses associated with the principal use pliers (02) and/or a new application.

The pliers tool (01) is arranged as a hosting pliers that attaches to, retains, and manipulates the separate, principal use pliers (02).

The hosting pliers are specially designed, shaped and provided with the PLBA (50) to function as a receiver/retainer, which is integral to its first ply (20) such that the PLBA (50) is configured to receive and retain a handle of the principal use pliers (02).

The hosting pliers are further equipped with frontward and rearward pivot joints and more to facilitate better movement of the combination of the pliers tool (01) and the principal use pliers (02).

The combination of the pliers tool (01) and the principal use pliers (02) may enable the pliers tool (01) to:

provide solutions to an uncomfortable or damaged handle of the principal use pliers (02) by allowing its user to bypass direct engagement with the handles of the principal use pliers (02); create greater force or less force through mechanical advantage when attaching to different points on the handles of the principal uses pliers (02); provide dynamic handle/jaw orientation options with bi-directional pivot/swivel joints facilitated by the P/SMP's (37) in the pliers tool (01) for working in challenging environments such as in congested areas or working overhead; enable greater or lesser torque application/leverage capabilities by creating an overall longer or shorter tool assembly by changing the insertion depths/attachment points of the handles of the principal use pliers (02) within the PLBA receiver (51) and the second receiver (40*b*) of the pliers tool (01); become an overall longer assembly or attach at a point on the handles of the principal use pliers (02) that is inaccessible to reach with a bare hand or disadvantageous to its user to apply the force needed for a given task; deliver increased and/or more steady force to the jaws of the principal use pliers (02) as facilitated by the FBLA (60), since the FBLA (60) in the pliers tool (01) alters the ratio of movement between the handles of the pliers tool (01) where force is applied by the user and the resulting movement at the working end of the tool assembly—the jaws of the principal use pliers (02)—such that the handles of the principal use pliers (02) where force is applied by the pliers tool (01) move less in relationship to the handles of the pliers tool (01) where force is applied by its user, thereby compounding and modulating the force applied to the jaws of the principal use pliers (02) when compared to using the principal use pliers (02) as a stand-alone tool; enable the locking of the handle/jaws of the principal use pliers (02) into a plurality of positions to manipulate or support a workpiece as facilitated by the over-center condition of the FBLA (60).

Furthermore, the pliers tool (01) may provide solutions to a non-insulated handle of the principal use pliers (02) as the pliers tool (01) may be insulated. Similarly, various exposed parts of the pliers tool (01) may be insulated to prevent conduction between such parts and their surroundings, which could otherwise cause problems such as arcing, and/or damage to electronics.

Finally, the combination of the pliers tool (01) and the principal use pliers (02) may enable the pliers tool (01) to: provide its user with an opportunity to focus on new or different aspects of challenging tasks otherwise unconsidered or too difficult to manage by offering its user previously non-existent, potential solutions resulting from a greater variety of tool-manipulation options, both simple and complex, compared to the limitations of the stand-alone, principal use pliers (02); provide combined user functionality with an intuitive design comprising various aids for the user such as purposefully designed, bi-directionally moving receivers, and the customized, compensatory PLBA (50); potentially incorporate quick and simple, yet sturdy and substantial adjustments in overall jaw capacity and/or handle length by transposing a receiver on the pliers tool (01), or implementing an extendable, sliding/locking mechanism along a frontward ply or handle of the pliers tool (01); and maintain its functions and integrity using durable materials like steel, aluminum, carbon fiber, or others in more demanding places while possibly using plastics or different materials in areas where weight, strength, cost or other considerations may not require or gain benefit from using more durable, heavy, or costly materials.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having thus described the invention, it is claimed:

1. A pliers tool (01), comprising:

a first ply (20) and a second ply (21) of innovatory shape(s), hingedly or otherwise movably connected to each other, formed to function as a hosting pliers such that it works in conjunction with, controls, and augments the benefits of a principal use pliers (02) having handles on rearward plies intended for direct engagement with a user's hand and jaws on frontward plies intended to directly engage a workpiece, whereas frontward plies of the pliers tool (01) are arranged to receive the handles of the principal use pliers (02) and one of the plies comprises a pressure loading box assembly (50), hereafter PLBA (50), having a PLBA band (52) that retains a handle of the principal use pliers (02) such that their combined arrangement works together to receive, support, and retain the handles of the principal use pliers (02);

said first and second plies (20 & 21) that are at least partially arcuate, curved, or otherwise sinuous and hingedly or movably connected to each other by a primary main hinge (22) that extends at least partially through both plies (20 & 21) as needed for attaching the two plies (20 & 21) to each other;

as needed in the pliers tool (01), attaching hardware (33), which may include various fasteners, nuts/bolts, washers/push washers, studs, spring washers, rivets, and/or the like such that its associated attachments/connections may be either static or dynamic, and attaching hardware (33) may be used in conjunction with other connection materials and/or methods such as adhesives, welding, and more;

a first rearward ply (23*a*) and a second rearward ply (23*b*) that are formed to be graspable as handles, and a first frontward ply (24*a*) and a second frontward ply (24*b*) that are formed to provide a first jaw (26*a*) and a second jaw (26*b*) wherein each of the rearward and frontward plies ends at and partially includes at least one of two main hinges that attaches the plies to each other and distinguishes them from their adjoining plies such that the primary main hinge (22) distinguishes the first rearward ply (23*a*), which extends rearward through an FBLA adjustment screw (68) to its rearward end, from the first frontward ply (24*a*), which extends frontward through a rigid, structural joint having tack/spot-welds and attaching hardware (33) that fixedly secures the first jaw (26*a*) as a member of the first frontward ply (24*a*), and the PLBA (50), to its frontward end;

a secondary main hinge (25) that distinguishes the second rearward ply (23*b*), which extends rearward through and includes an FBLA release lever (69) near its rearward end, from the second frontward ply (24*b*), which extends frontward through a second receiver assembly (401*b*) to its frontward end;

the second jaw (26*b*) as a member of the second frontward ply (24*b*) wherein it is hingedly connected at both of the two main hinges (22 & 25), whereas the first jaw (26*a*) is a fixedly-attached member of the first frontward ply (24*a*);

said first and second rearward plies (23*a* & 23*b*) that are further connected to each other by an FBLA rearward bar (64);

a four-bar linkage assembly (60), hereafter referred to as FBLA (60), that it is formed within the graspable, direct-engagement handles of the pliers tool's (01) first and second rearward plies (23*a* & 23*b*), wherein the FBLA (60) facilitates an integrally applied concept inherent to the pliers tool (01) that is made up of four bars and other elements wherein an FBLA first ply bar (61) is a section of the first rearward ply (23*a*) assembly partially including and extending from the primary main hinge (22) at one end and continuing to and partially including at its other end an FBLA adjustable hinge (66) along the first rearward ply (23*a*);

an FBLA frontward bar (62) that is an intermediate section of the second frontward ply (24*b*) partially including and having at each end one of the two main hinges (22 & 25) and spanning from one to the other;

an FBLA second ply bar (63) that is a section of the second rearward ply (23*b*) partially including and extending from the secondary main hinge (25) at one end and continuing to and partially including at its other end an FBLA over-center hinge (65);

the FBLA rearward bar (64) that is a member partially including and extending from the FBLA over-center hinge (65) at one end and continuing to and partially including at its other end the FBLA adjustable hinge (66) along the first rearward ply (23*a*);

the FBLA adjustable hinge (66) that is formed by a confluence of the FBLA first ply bar (61) and the FBLA rearward bar (64) where they engage together the hinge-end of the FBLA adjustment screw (68) such that their containment within an FBLA slotted tubular section (61*a*) is supported and maintained by an FBLA rear bar raised protrusion (64*a*) at the end of the FBLA rearward bar (64) such that said raised protrusion (64*a*) is large enough to retain the end of the FBLA rearward bar (64) within said slotted tubular section (61*a*) of the first rearward ply (23*a*) while being small enough, smooth enough, and shaped accordingly to fit and move freely within and along said slotted tubular section (61*a*);

an FBLA tension spring (67) that attaches at one end to the FBLA frontward bar (62) and at the other end to the FBLA first ply bar (61) such that the FBLA rearward bar (64) is driven by the force of the FBLA tension spring (67) to slide internally along the FBLA slotted tubular section (61*a*) of the FBLA first ply bar (61) until it engages and is stopped by the hinge-end of the FBLA adjustment screw (68), which is threaded into the rearward end of the first rearward ply (23*a*), and the spring tension applied by the FBLA tension spring (67) transfers through the entire, hingedly-formed FBLA (60);

the FBLA release lever (69) that is movably attached with attaching hardware (33) to the rearward section of the second rearward ply (23*b*);

the fixedly-attached, first jaw (26*a*) as a member of the first frontward ply (24*a*) and at its frontward end the PLBA (50) that further comprises a PLBA receiver (51), the PLBA band (52), a PLBA band guide (53), and a PLBA spring (55);

the first frontward ply (24*a*) that further comprises a first receiver attaching plate (35*a*), a pivot/swivel mounting plate (37), hereafter P/SMP (37), and attaching hardware (33) such that the PLBA (50) is fastened with attaching hardware (33) to one of the P/SMP's (37) and the combined assembly is movably fastened with attaching hardware (33) to the first jaw (26*a*);

said PLBA (50) that extends from a portion of the first jaw (26*a*) such that the PLBA receiver (51) directly engages a handle of the principal use pliers (02) and the PLBA (50) is arranged to facilitate the dynamic requirements of both a receiver and a retainer as part of the pliers tool (01) such that the arrangement of the PLBA's (50) moving and non-moving parts enable the PLBA receiver (51) and the interactive, pressure-based PLBA band (52) to be forcefully guided toward each other such that they create a movement-compensating vice/retainer for a handle of the principal use pliers (02);

said PLBA receiver (51) and PLBA band (52) that are each generally a single, hollow or open member of the PLBA (50) wherein the PLBA receiver (51) and the PLBA band (52) work together such that the PLBA band (52) has a guided travel for retention/closure through the PLBA receiver (51) to retain a handle of the principal use pliers (02) positioned between an interior, more curved surface of the PLBA band (52) and an opposing interior surface of the PLBA receiver (51);

interior walls of the PLBA band (52) that are guided by external surfaces on sides of cut-out sections of the PLBA receiver (51) and/or the PLBA band guide (53);

said PLBA band guide (53) that it is attached by attaching hardware (33), superimposing it over the first receiver attaching plate (35*a*) where it assists in guiding the travel of the PLBA band (52);

the PLBA spring (55) that it is compressed between and applies force against a primary exposed surface of the PLBA band guide (53) and an opposing, interior side of the PLBA band (52) where its end positions are secured by materials and/or methods that may include an industrial adhesive, a hole/tab insertion, a spot weld, or another material/method of securement;

the arrangement of parts in the PLBA (50) such that the PLBA spring (55) forces the PLBA band (52) toward the PLBA receiver (51) so as to retain by pinning between them a handle of the principal use pliers (02) such that in this parts assembly/relationship the PLBA (50) allows a handle of the principal use pliers (02) to have some movement between the PLBA receiver (51) and the PLBA band (52) within the assembly without the assembly releasing the handle as enabled by secure, but somewhat loose, construction considered in the relationship between the PLBA band (52) and other parts acting to support and/or guide the PLBA band (52), such as the PLBA receiver (51) and the PLBA band guide (53), wherein this relatively loose construction may facilitate a more accommodating, compensatory capacity of the PLBA (50) to better meet the demands of the pliers tool (01) and the principal use pliers (02) as they work together;

at the frontward end of the second frontward ply (24*b*) the second receiver assembly (401*b*), that further comprises a second receiver (40*b*), a second receiver attaching plate (35*b*), one of the P/SMP's (37), and attaching hardware (33) such that the second receiver (40*b*) extends from a portion of the second jaw (26*b*) and directly engages a handle of the principal use pliers (02);

the PLBA (50) and the second receiver assembly (401*b*), wherein each attaches movably to the frontward end of its first or second respective jaw (26*a*/26*b*) such that the attaching plate of each assembly, the first receiver attaching plate (35*a*) and the second receiver attaching plate (35*b*), is movably connected to one of the P/SMP's (37) by attaching hardware (33) that begins its retention in each assembly with a shaft component having an oversized, widened head/end for retention such that after being passed through the receiver it retains the receiver from an interior location within the receiver where a hole has been drilled through the receiver to accommodate the shaft that secures the receiver as part of the assembly;

said attaching hardware (33) shaft component that secures each receiver to its assembly and one of the P/SMP's (37) to same by passing through a drilled hole in each of the first and second receiver attaching plates (35*a* & 35*b*) and a drilled hole through the center of one of the P/SMP's (37) where it is then secured to said P/SMP (37) with a retaining washer as attaching hardware (33) and an industrial adhesive;

said P/SMP (37), having attached to it a receiver assembly, that is then attached to its respective jaw with attaching hardware (33), such as a small nut/bolt arrangement, wherein the bolt passes through holes drilled through each of two exposed protrusions of the P/SMP (37) and the frontward end of the jaw such that said two exposed protrusions of the P/SMP (37) are positioned astride the hole in the jaw before being secured to it with said nut/bolt arrangement;

each of the P/SMP's (37) being hingedly or movably attached to each jaw so as to allow a handle of the principal use pliers (02) to pivot forward and rearward relative to the pliers tool (01) while their combination remains on an axis/plane generally shared between them such that the P/SMP's (37) frontward and rearward pivoting allowances help to facilitate movement needed for the normal opening and closing of the principal use pliers (02) hosted by the pliers tool (01) wherein each of the P/SMP's (37) independently accommodates variations in movements of a handle of the principal use pliers (02) supported by a receiver of the pliers tool (01) without binding or limiting its range of pivoting or teetering forward and rearward relative to the pliers tool (01) as the pliers tool (01) and the principal use pliers (02) open and close together;

the first and second receiver attaching plates (35*a* & 35*b*), each one attaching to one of the P/SMP's (37) such that their junction is formed by their generally flat mating surfaces that when pressed together facilitate the swiveling motion of their respective receiver, which in turn enables a handle of the principal use pliers (02) to orientate away from the body of the pliers tool (01) on a rotational axis/plane such that when both receivers are equipped to and forced to swivel together the handles of the pliers tool (01) and the principal use pliers (02) each occupy separate planes as opposed to the single, general-geometric plane otherwise shared by their handle-sets;

said moveable swivel junctions at the P/SMP's (37) and the first and second receiver attaching plates (35*a* &

35*b*) that facilitate swiveling to enable multi-planar orientations, which increase the versatility and functionality of the pliers tool (01);

the FBLA second ply bar (63) and the FBLA rearward bar (64), which may become parallel to each other under load across the FBLA over-center hinge (65) if the jaws of the pliers tool (01) are closed with enough force by its user to overcome an opposing counter-force of a workpiece, for example, providing the FBLA adjustable hinge (66) is positioned to facilitate said parallel bars (63 & 64) under load such that once said two bars (63 & 64) become parallel—making a single, hinged, linear bar—under load and they are further forced to break parallel on the opposite side from where they started, by the laws of physics they become locked into position if their continued movement on the opposite side from where they started is restricted somewhere generally understood to be over-center or beyond parallel, whereafter the force of said workpiece once working to separate the jaws of the pliers tool (01) is redirected through the linkage assembly such that it keeps the jaws of the pliers tool (01) locked closed indefinitely until either a disrupting, external-disengagement force is applied, such as intentional disengagement by the user, or the tool arrangement or workpiece fails; and the FBLA over-center hinge (65), which associates the FBLA second ply bar (63) and the FBLA rearward bar (64) with being over-center relative to itself and both the secondary main hinge (25) and the FBLA adjustment hinge (66) wherein their beyond-parallel, over-center condition is configured to stop slightly over-center when the curved section of the FBLA rearward bar (64) is pressed against the frontward end of the FBLA release lever (69) to the extent that the force against the frontward end of said release lever (69) will pop the rearward end of said release lever (69) into the ready position for disengaging the over-center locking feature when both the FBLA rearward bar (64) and the frontward end of the FBLA release lever (69) are stopped together by the body of the second rearward ply (23*b*) such that once locked into the exposed, ready position, squeezing the rearward end of the FBLA release lever (69) firmly toward the body of its respective handle creates a leveraging force that should separate the handles enough to bring the two bars back across parallel to overcome and disengage the over-center, locking feature.

2. A pliers tool (01), comprising:

a first ply (20) and a second ply (21) of innovatory shape(s), hingedly or otherwise movably connected to each other, formed to function as a hosting pliers such that it works in conjunction with, controls, and augments the benefits of a principal use pliers (02) having handles on rearward plies intended for direct engagement with a user's hand and jaws on frontward plies intended to directly engage a workpiece, whereas each frontward ply of the pliers tool (01) is arranged to receive and retain the handles of the principal use pliers (02) such that their combined arrangement works together to receive, support, and retain the handles of the principal use pliers (02);

said first and second plies (20 & 21) further distinguishable in that each ply has a rearward and frontward ply relative to their shared, connecting hinge;

as needed in the pliers tool (01), attaching hardware (33), which may include various fasteners, nuts/bolts, washers/push washers, studs, spring washers, rivets, and/or the like such that its associated attachments/connections may be either static or dynamic, and attaching hardware (33) may be used in conjunction with other connection materials and/or methods such as adhesives, welding, and more;

a pressure loading box assembly (50), hereafter the PLBA (50), on a first frontward ply (24*a*) of the pliers tool (01) that further comprises a PLBA receiver (51), a PLBA band (52) that retains a handle of the principal use pliers (02), a PLBA band guide (53), and a PLBA spring (55);

said PLBA (50) that extends from or is integral to a portion of a first jaw (26*a*) such that the PLBA receiver (51) directly engages a handle of the principal use pliers (02);

said PLBA (50) that is arranged to facilitate the dynamic requirements of both a receiver and a retainer as part of the pliers tool (01) such that the arrangement of the PLBA's (50) moving and non-moving parts enable the PLBA receiver (51) and the interactive, pressure-based PLBA band (52) to be forcefully guided towards each other such that they create a movement-compensating vice/retainer for a handle of the principal use pliers (02);

said PLBA receiver (51) and PLBA band (52) that are each generally a single, hollow or open member of the PLBA (50) wherein the PLBA receiver (51) and the PLBA band (52) work together such that the PLBA band (52) has a guided travel for retention/closure through the PLBA receiver (51) to retain a handle of the principal use pliers (02) positioned between an interior, more curved surface of the PLBA band (52) and an opposing interior surface of the PLBA receiver (51);

interior walls of the PLBA band (52) that are guided by external surfaces on sides of cut-out sections of the PLBA receiver (51) and/or the PLBA band guide (53);

said PLBA band guide (53) that it is attached by attaching hardware (33), superimposing it over a first receiver attaching plate (35*a*) where it assists in guiding the travel of the PLBA band (52);

the PLBA spring (55) that it is compressed between and applies force against a primary exposed surface of the PLBA band guide (53) and an opposing, interior side of the PLBA band (52) where its end positions are secured by materials and/or methods that may include an industrial adhesive, a hole/tab insertion, a spot weld, or another material/method of securement;

the arrangement of parts in the PLBA (50) such that the PLBA spring (55) forces the PLBA band (52) toward the PLBA receiver (51) so as to retain by pinning between them a handle of the principal use pliers (02) such that in this parts assembly/relationship the PLBA (50) allows a handle of the principal use pliers (02) to have some movement between the PLBA receiver (51) and the PLBA band (52) within the assembly without the assembly releasing the handle as enabled by secure, but somewhat loose, construction considered in the relationship between the PLBA band (52) and other parts acting to support and/or guide the PLBA band (52), such as the PLBA receiver (51) and the PLBA band guide (53), wherein this relatively loose construction may facilitate a more accommodating, compensatory capacity of the PLBA (50) to better meet the demands of the pliers tool (01) and the principal use pliers (02) as they work together; and a frontward and rearward pivoting element on a frontward ply of the pliers tool (01) to facilitate frontward and rearward pivoting of a handle of the principal use pliers (02).

3. A pliers tool (01), comprising:

a first ply (20) and a second ply (21) of innovatory shape(s), hingedly or otherwise movably connected to each other, formed to function as a hosting pliers such that it works in conjunction with, controls, and augments the benefits of a principal use pliers (02) having handles on rearward plies intended for direct engagement with a user's hand and jaws on frontward plies intended to directly engage a workpiece, whereas frontward plies of the pliers tool (01) are arranged to receive the handles of the principal use pliers (02) and one of the plies comprises a pressure loading box assembly (50), hereafter PLBA (50), having a PLBA band (52) that retains a handle of the principal use pliers (02) such that their combined arrangement works together to receive, support, and retain the handles of the principal use pliers (02);

said first and second plies (20 & 21) further distinguishable in that each ply has a rearward and frontward ply relative to their shared, connecting hinge;

as needed in the pliers tool (01), attaching hardware (33), which may include various fasteners, nuts/bolts, washers/push washers, studs, spring washers, rivets, and/or the like such that its associated attachments/connections may be either static or dynamic, and attaching hardware (33) may be used in conjunction with other connection materials and/or methods such as adhesives, welding, and more;

the PLBA (50) on a first frontward ply (24*a*) of the pliers tool (01) that further comprises a PLBA receiver (51), the PLBA band (52) that retains a handle of the principal use pliers (02), a PLBA band guide (53), and a PLBA spring (55);

said PLBA (50) that extends from or is integral to a portion of a first jaw (26*a*) such that the PLBA receiver (51) directly engages a handle of the principal use pliers (02);

said PLBA (50) that is arranged to facilitate the dynamic requirements of both a receiver and a retainer as part of the pliers tool (01) such that the arrangement of the PLBA's (50) moving and non-moving parts enable the PLBA receiver (51) and the interactive, pressure-based PLBA band (52) to be forcefully guided towards each other such that they create a movement-compensating vice/retainer for a handle of the principal use pliers (02);

said PLBA receiver (51) and PLBA band (52) that are each generally a single, hollow or open member of the PLBA (50) wherein the PLBA receiver (51) and the PLBA band (52) work together such that the PLBA band (52) has a guided travel for retention/closure through the PLBA receiver (51) to retain a handle of the principal use pliers (02) positioned between an interior, more curved surface of the PLBA band (52) and an opposing interior surface of the PLBA receiver (51);

interior walls of the PLBA band (52) that are guided by external surfaces on sides of cut-out sections of the PLBA receiver (51) and/or the PLBA band guide (53);

said PLBA band guide (53) that it is attached by attaching hardware (33), superimposing it over a first receiver attaching plate (35*a*) where it assists in guiding the travel of the PLBA band (52);

the PLBA spring (55) that it is compressed between and applies force against a primary exposed surface of the PLBA band guide (53) and an opposing, interior side of the PLBA band (52) where its end positions are secured by materials and/or methods that may include an industrial adhesive, a hole/tab insertion, a spot weld, or another material/method of securement;

the arrangement of parts in the PLBA (50) such that the PLBA spring (55) forces the PLBA band (52) toward the PLBA receiver (51) so as to retain by pinning between them a handle of the principal use pliers (02) such that in this parts assembly/relationship the PLBA (50) allows a handle of the principal use pliers (02) to have some movement between the PLBA receiver (51) and the PLBA band (52) within the assembly without the assembly releasing the handle as enabled by secure, but somewhat loose, construction considered in the relationship between the PLBA band (52) and other parts acting to support and/or guide the PLBA band (52), such as the PLBA receiver (51) and the PLBA band guide (53), wherein this relatively loose construction may facilitate a more accommodating, compensatory capacity of the PLBA (50) to better meet the demands of the pliers tool (01) and the principal use pliers (02) as they work together;

a set of rotational-swivel elements on frontward plies of the pliers tool (01) to facilitate swiveling of the principal use pliers (02) away from the axis or plane otherwise shared by the combination of the principal use pliers (02) and pliers tool (01) when connected to each other as facilitated by the pliers tool (01); and a frontward and rearward pivoting element on a frontward ply of the pliers tool (01) to facilitate frontward and rearward pivoting of a handle of the principal use pliers (02).

4. A pliers tool (01), comprising:

a first ply (20) and a second ply (21) of innovatory shape(s), hingedly or otherwise movably connected to each other by a primary main hinge (22), formed to function as a hosting pliers such that it works in conjunction with, controls, and augments the benefits of a principal use pliers (02) having handles on rearward plies intended for direct engagement with a user's hand and jaws on frontward plies intended to directly engage a workpiece, whereas each frontward ply of the pliers tool (01) is arranged to receive and retain the handles of the principal use pliers (02) such that their combined arrangement works together to receive, support, and retain the handles of the principal use pliers (02);

said primary main hinge (22) that attaches to and distinguishes from each other the first and second plies (20 & 21) and further distinguishes a first rearward ply (23*a*) from a first frontward ply (24*a*);

said second ply (21) having an additional, structural, and hinged/movable connection as a secondary main hinge (25) of the pliers tool (01), which distinguishes a second rearward ply (23*b*) from a second frontward ply (24*b*) and comprises one of four hinges of a four-bar linkage assembly (60) that is inherent to the combined rearward plies (23*a* & 23*b*) of the pliers tool (01) so as to provide a variety of user-benefits;

as needed in the pliers tool (01), attaching hardware (33), which may include various fasteners, nuts/bolts, washers/push washers, studs, spring washers, rivets, and/or the like such that its associated attachments/connections may be either static or dynamic, and attaching hardware (33) may be used in conjunction with other connection materials and/or methods such as adhesives, welding, and more;

a pressure loading box assembly (50), hereafter the PLBA (50), on the first frontward ply (24*a*) of the pliers tool (01) that further comprises a PLBA receiver (51), a PLBA band (52) that retains a handle of the principal use pliers (02), a PLBA band guide (53), and a PLBA spring (55);

said PLBA (50) that extends from or is integral to a portion of a first jaw (26*a*) such that the PLBA receiver (51) directly engages a handle of the principal use pliers (02);

said PLBA (50) that is arranged to facilitate the dynamic requirements of both a receiver and a retainer as part of the pliers tool (01) such that the arrangement of the PLBA's (50) moving and non-moving parts enable the PLBA receiver (51) and the interactive, pressure-based PLBA band (52) to be forcefully guided towards each other such that they create a movement-compensating vice/retainer for a handle of the principal use pliers (02);

said PLBA receiver (51) and PLBA band (52) that are each generally a single, hollow or open member of the PLBA (50) wherein the PLBA receiver (51) and the PLBA band (52) work together such that the PLBA band (52) has a guided travel for retention/closure through the PLBA receiver (51) to retain a handle of the principal use pliers (02) positioned between an interior, more curved surface of the PLBA band (52) and an opposing interior surface of the PLBA receiver (51);

interior walls of the PLBA band (52) that are guided by external surfaces on sides of cut-out sections of the PLBA receiver (51) and/or the PLBA band guide (53);

said PLBA band guide (53) that it is attached by attaching hardware (33), superimposing it over a first receiver attaching plate (35*a*) where it assists in guiding the travel of the PLBA band (52);

the PLBA spring (55) that it is compressed between and applies force against a primary exposed surface of the PLBA band guide (53) and an opposing, interior side of the PLBA band (52) where its end positions are secured by materials and/or methods that may include an industrial adhesive, a hole/tab insertion, a spot weld, or another material/method of securement;

the arrangement of parts in the PLBA (50) such that the PLBA spring (55) forces the PLBA band (52) toward the PLBA receiver (51) so as to retain by pinning between them a handle of the principal use pliers (02) such that in this parts assembly/relationship the PLBA (50) allows a handle of the principal use pliers (02) to have some movement between the PLBA receiver (51) and the PLBA band (52) within the assembly without the assembly releasing the handle as enabled by secure, but somewhat loose, construction considered in the relationship between the PLBA band (52) and other parts acting to support and/or guide the PLBA band (52), such as the PLBA receiver (51) and the PLBA band guide (53), wherein this relatively loose construction may facilitate a more accommodating, compensatory capacity of the PLBA (50) to better meet the demands of the pliers tool (01) and the principal use pliers (02) as they work together; and a frontward and rearward pivoting element on a frontward ply of the pliers tool (01) to facilitate frontward and rearward pivoting of a handle of the principal use pliers (02).

5. A pliers tool (01), comprising:

a first ply (20) and a second ply (21) of innovatory shape(s), hingedly or otherwise movably connected to each other by a primary main hinge (22), formed to function as a hosting pliers such that it works in conjunction with, controls, and augments the benefits of a principal use pliers (02) having handles on rearward plies intended for direct engagement with a user's hand and jaws on frontward plies intended to directly engage a workpiece, whereas frontward plies of the pliers tool (01) are arranged to receive the handles of the principal use pliers (02) and one of the plies comprises a pressure loading box assembly (50), hereafter PLBA (50), having a PLBA band (52) that retains a handle of the principal use pliers (02) such that their combined arrangement works together to receive, support, and retain the handles of the principal use pliers (02);

said primary main hinge (22) that attaches to and distinguishes from each other the first and second plies (20 & 21) and further distinguishes a first rearward ply (23*a*) from a first frontward ply (24*a*);

said second ply (21) having an additional, structural, and hinged/movable connection as a secondary main hinge (25) of the pliers tool (01), which distinguishes a second rearward ply (23*b*) from a second frontward ply (24*b*) and comprises one of four hinges of a four-bar linkage assembly (60) that is inherent to the combined rearward plies (23*a* & 23*b*) of the pliers tool (01) so as to provide a variety of user-benefits;

as needed in the pliers tool (01), attaching hardware (33), which may include various fasteners, nuts/bolts, washers/push washers, studs, spring washers, rivets, and/or the like such that its associated attachments/connections may be either static or dynamic, and attaching hardware (33) may be used in conjunction with other connection materials and/or methods such as adhesives, welding, and more;

the PLBA (50) on the first frontward ply (24*a*) of the pliers tool (01) that further comprises a PLBA receiver (51), the PLBA band (52) that retains a handle of the principal use pliers (02), a PLBA band guide (53), and a PLBA spring (55);

said PLBA (50) that extends from or is integral to a portion of a first jaw (26*a*) such that the PLBA receiver (51) directly engages a handle of the principal use pliers (02);

said PLBA (50) that is arranged to facilitate the dynamic requirements of both a receiver and a retainer as part of the pliers tool (01) such that the arrangement of the PLBA's (50) moving and non-moving parts enable the PLBA receiver (51) and the interactive, pressure-based PLBA band (52) to be forcefully guided towards each other such that they create a movement-compensating vice/retainer for a handle of the principal use pliers (02);

said PLBA receiver (51) and PLBA band (52) that are each generally a single, hollow or open member of the PLBA (50) wherein the PLBA receiver (51) and the PLBA band (52) work together such that the PLBA band (52) has a guided travel for retention/closure through the PLBA receiver (51) to retain a handle of the principal use pliers (02) positioned between an interior, more curved surface of the PLBA band (52) and an opposing interior surface of the PLBA receiver (51); interior walls of the PLBA band (52) that are guided by external surfaces on sides of cut-out sections of the PLBA receiver (51) and/or the PLBA band guide (53);

said PLBA band guide (53) that it is attached by attaching hardware (33), superimposing it over a first receiver attaching plate (35*a*) where it assists in guiding the travel of the PLBA band (52);

the PLBA spring (55) that it is compressed between and applies force against a primary exposed surface of the PLBA band guide (53) and an opposing, interior side of the PLBA band (52) where its end positions are secured by materials and/or methods that may include an industrial adhesive, a hole/tab insertion, a spot weld, or another material/method of securement;

the arrangement of parts in the PLBA (50) such that the PLBA spring (55) forces the PLBA band (52) toward the PLBA receiver (51) so as to retain by pinning between them a handle of the principal use pliers (02) such that in this parts assembly/relationship the PLBA (50) allows a handle of the principal use pliers (02) to have some movement between the PLBA receiver (51) and the PLBA band (52) within the assembly without the assembly releasing the handle as enabled by secure, but somewhat loose, construction considered in the relationship between the PLBA band (52) and other parts acting to support and/or guide the PLBA band (52), such as the PLBA receiver (51) and the PLBA band guide (53), wherein this relatively loose construction may facilitate a more accommodating, compensatory capacity of the PLBA (50) to better meet the demands of the pliers tool (01) and the principal use pliers (02) as they work together;

a set of rotational-swivel elements on frontward plies of the pliers tool (01) to facilitate swiveling of the principal use pliers (02) away from the axis or plane otherwise shared by the combination of the principal use pliers (02) and pliers tool (01) when connected to each other as facilitated by the pliers tool (01); and a frontward and rearward pivoting element on a frontward ply of the pliers tool (01) to facilitate frontward and rearward pivoting of a handle of the principal use pliers (02).

* * * * *